United States Patent [19]

Monte

[11] Patent Number: 4,592,301

[45] Date of Patent: Jun. 3, 1986

[54] FIRE EXTINGUISHER SUPPORT MECHANISM INCORPORATING AN AUDIBLE ALARM

[76] Inventor: Anthony J. Monte, 47660 Bluebird, Utica, Mich. 48087

[21] Appl. No.: 611,275

[22] Filed: May 17, 1984

[51] Int. Cl.[4] ..... G08B 13/14

[52] U.S. Cl. ..... 116/67 R; 169/23; 116/162

[58] Field of Search ..... 116/162, 67 R, 155; 169/23

[56] References Cited

U.S. PATENT DOCUMENTS

| | | | |
|---|---|---|---|
| 301,862 | 7/1884 | Chase | 116/162 |
| 466,116 | 12/1891 | Brown | 116/155 |
| 2,085,860 | 7/1937 | Lambert | 116/162 |
| 3,893,095 | 7/1975 | DeJong | 169/23 |
| 4,360,802 | 11/1982 | Pinto | 169/23 |

*Primary Examiner*—Charles Frankfort
*Assistant Examiner*—Denis E. Corr
*Attorney, Agent, or Firm*—John E. McRae; Robert P. Gibson; Peter A. Taucher

[57] ABSTRACT

A mechanism for supporting a conventional portable fire extinguisher wherein the support mechanism is modified or adapted to include an audible warning device such as a siren, whistle or bell. When a person removes the extinguisher from the support mechanism an audible warning sound is generated to alerted nearby individuals of the existence of a fire or the fact that the extinguisher may be in the process of being stolen. The individuals are thus alerted to the requirement for some action on their part.

1 Claim, 4 Drawing Figures

FIRE EXTINGUISHER SUPPORT MECHANISM INCORPORATING AN AUDIBLE ALARM

GOVERNMENT INTEREST

The invention described herein may be manufactured, used, and licensed by or for the Government for governmental purposes without payment to me of any royalty thereon.

BACKGROUND AND SUMMARY

This invention relates to mechanism for supporting a portable fire extinguisher in the standby position. The principal aim of the invention is to provide in the support mechanism an audible alarm unit responsive to movement of the extinguisher from the mechanism. When the extinguisher is lifted from the support mechanism an audible warning noise (e.g. siren, whistle, bell ringing) is produced. The warning noise alerts other persons in the area that the extinguisher is being used to put out a fire or that the extinguisher is being stolen. In either event, persons in the area are informed of a situation necessitating some action on their part, e.g. evacuate the area, assist the person putting out the fire, apprehend the thief, etc.

THE DRAWINGS

Figure 1:
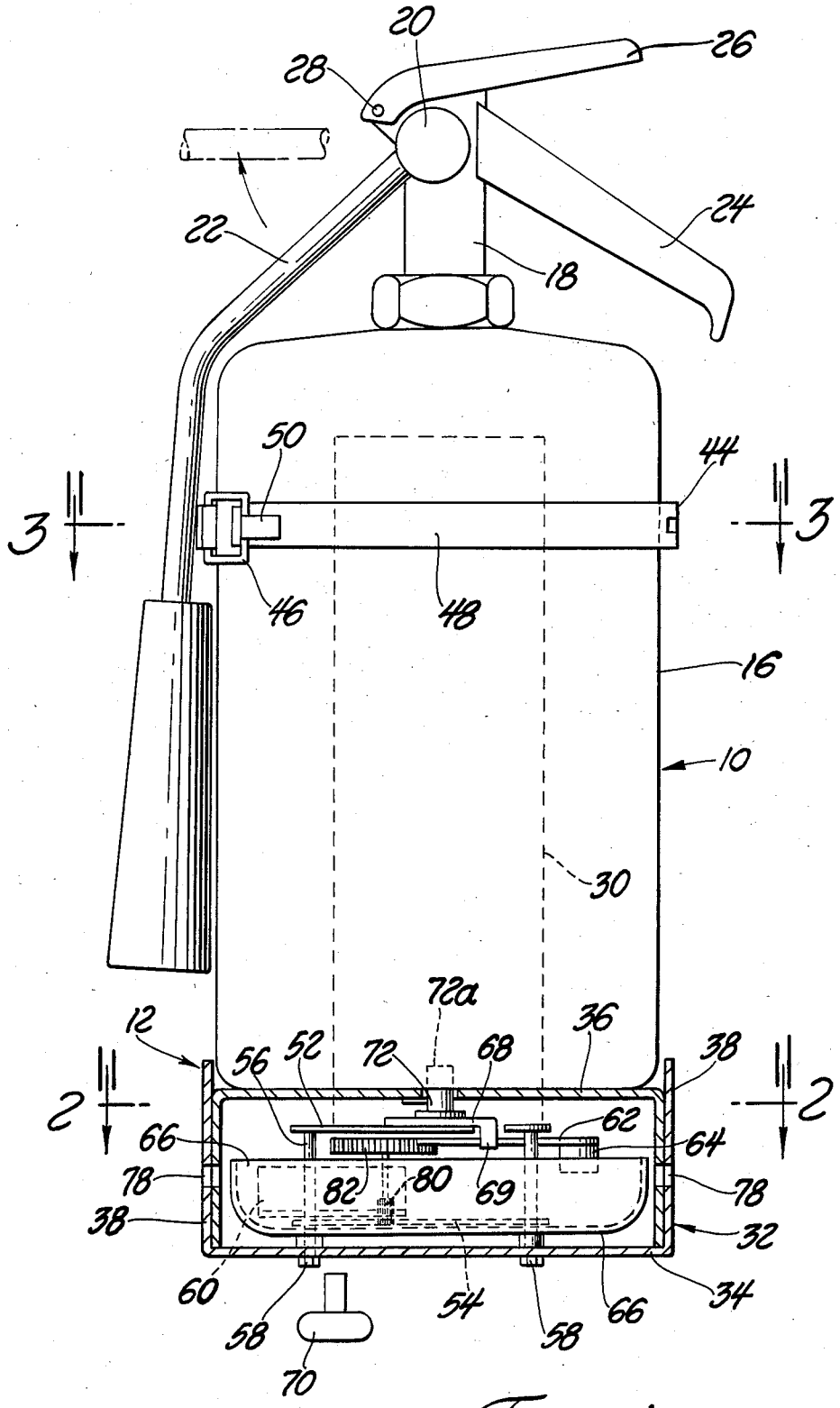
FIG. 1 is an elevational view of a support mechanism and supported fire extinguisher, with certain parts of the support mechanism in section. The extinguisher is a conventional piece of apparatus; the support mechanism incorporates features of my invention.
Figure 3:
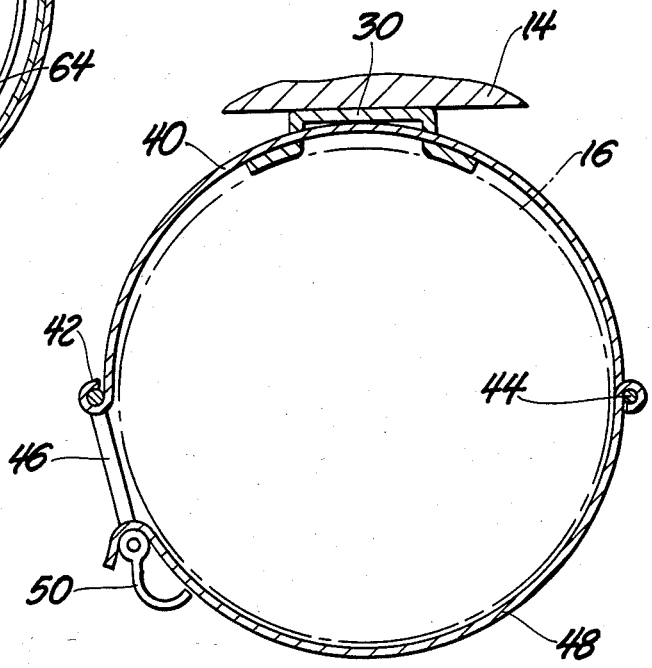
FIG. 3 is a sectional view on line 3—3 in FIG. 1.

Referring more particularly to FIGS. 1 and 3, there is shown a conventional representative fire extinguisher 10 and support mechanism 12 for retaining the extinguisher in a standby position in close adjacency to a building wall 14.

The extinguisher may be any commercially available unit, e.g. model ASP manufactured by American Safety Products Division of ASP International Inc. of Cleveland, Tenn. or an extinguisher manufactured by Metalcraft Inc. of Baltimore, Md.

The illustrated extinguisher comprises a pressure-resistant cylindrical bottle 16 charged with a suitable fire extinguishant such as Halon 1301; pressurizing agent may be nitrogen at 700 p.s.i.

The upper end of the bottle carries a valve housing 18 which has a swivel mount 20 for a discharge tube 22. A lifter handle 24 is affixed to the valve housing for manual transport of the extinguisher to the fire zone. A manual valve operator 26 is movable around pivot axis 28 to effect discharge of fire extinguishant onto the fireball.

The illustrated support mechanism 12 comprises a vertical channel 30 securable to wall 14, and a hollow base structure 32 welded or otherwise affixed to channel 30. Base structure 32 comprises a circular bottom wall 34, circular platform 36 and annular sidewall 38. The structure is sized so that platform 36 can supportably engage the end wall of fire extinguisher bottle 16.

The fire extinguisher is retained in an upright position on the support mechanism by conventional strap or band mechanism, illustrated in FIG. 3 as a semi-circular band 40 having hinge connections 42 and 44 with latch buckle 46 and metal strap 48. A manually-actuable lever 50 is used to unhook strap 48 from buckle 46, after which the fire extinguisher can be removed from the support mechanism.

My invention relates particularly to an alarm mechanism located within base structure 32, i.e. the chamber circumscribed by wall members 34, 36 and 38. The alarm mechanism is preferably a commercially available unit, e.g. the Type 77 alarm train manufactured by General Time Corporation of Athens, Ga.

When the alarm unit is actuated it emits an audible alarm signal; in the case of the referenced Type 77 alarm train the audible signal is a ringing alarm similar to the sound produced by an alarm clock or fire alarm. Other types of alarm signals are contemplated, such as whistles or sirens.

The alarm could be accompanied by the generation of an electric signal, usable for example in a large building having a central surveillance station for personal security, fire, and safety purposes. By electrically connecting each fire extinguisher support mechanism to the central station it would be possible to instantly inform central station personnel of the fact that an extinguisher was being removed from the support mechanism, either to put out a fire or as a theft action. The alarm unit in FIGS. 1 and 2 does not include electric signal means, but it could be modified to include this feature.

Figure 2:
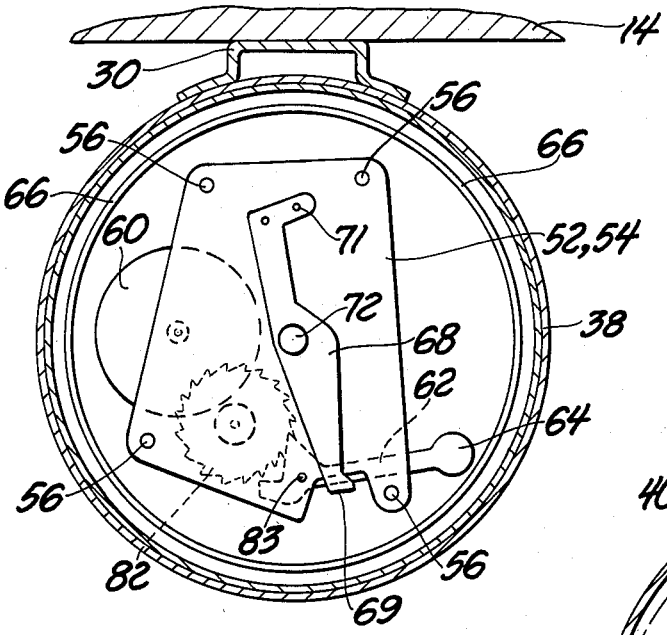
FIG. 2 is a sectional view on line 2—2 in FIG. 1.

As shown schematically in FIGS. 1 and 2, the alarm mechanism comprises upper and lower plates 52 and 54 connected by four vertical rods 56. The lower threaded ends of the rods project through openings in the base structure bottom wall to receive nuts 58 for mounting the alarm unit in place.

The alarm unit includes a conventional spiral spring motor 60 operable to produce oscillating motion of a lever 62; a hammer 64, carried by the lever, strikes the inner surface of a cup-shaped gong or bell 66 to produce an audible signal. Lever 62 is normally restrained against oscillatory motion by means of an overlying leaf spring 68; downturned end 69 of the spring latches the lever against oscillation.

A key 70 (FIG. 1) can be inserted into a non-circular socket in spring motor 60 to initially wind up the spiral spring for later operation of lever 62 (When the fire extinguisher is removed from the support mechanism). Base bottom wall 34 has a suitable opening enabling key 70 to engage the socket wind-up operator shaft for spring motor 60.

The alarm unit comprises a sensor button or plunger 72 projecting upwardly from leaf spring 68 through an opening in platform 36. End 71 (FIG. 2) of spring 68 is riveted or otherwise affixed to plate 52, whereas the other end of the spring is free to move up or down. In its free (unbiased) state the spring would be inclined upwardly from its illustrated position, such that plunger 72 would occupy its dashed line position **72*a*. However, the weight of the fire extinguisher on support platform 36 moves plunger 72 downwardly, thus depressing the leaf spring to a position wherein its end 69 restrains lever 62** against ringing motion.

Wind-up key 70 would normally be used to wind up spring motor 60 after the extinguisher was in position on platform 36. When the extinguisher is later removed, to put out a fire or as a theft action, spring 68 biases sensor 72 upwardly to its dashed line position; lever 62 is then free to oscillate hammer 64 against gong 66. The audible signal produced by the gong will be transmitted through openings 78 in base structure sidewall 38. Preferably such openings are formed around (along) the entire peripheral dimension of wall 38.

Any suitable mechanism can be used to translate spring motor 60 unwind action into lever 62 oscillation. As shown, the mechanism comprises a small gear wheel 80 engaged with a large gear formed on the reel for spring motor 60. The mounting shaft for gear 80 carries an escape wheel 82 having peripheral teeth in driving contact with end areas of lever 62. Lever 62 has a pivot axis 83.

The specific drive mechanism is not my contribution. My invention is directed more particularly to the arrangement wherein sensor 72 responds to the presence (or absence) of a fire extinguisher on platform 36, to thus trigger the alarm unit into its signalling mode only when the extinguisher is being removed from the support mechanism.

Figure 4:
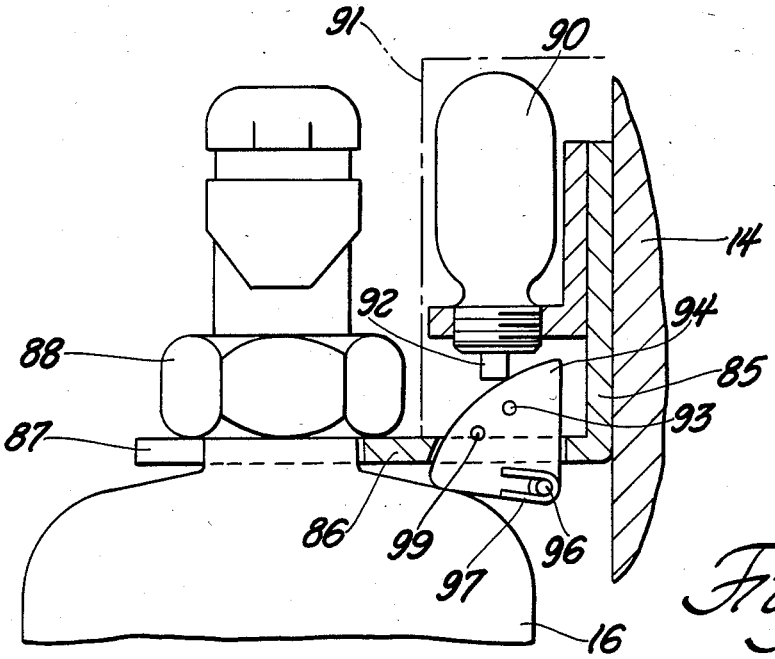
FIG. 4 is a fragmentary view of a second structure embodying my invention.

In some cases, fire extinguishers are supported by suspending them from wall-mounted hooks or brackets. FIG. 4 illustrates one way that my invention might be incorporated into such suspension-type support mechanisms. The illustrated suspension bracket 85 comprises a horizontal plate 86 having a slot 87 in its left edge to receive the neck area of fire extinguisher bottle 16. The neck area conventionally is threaded to receive a nut 88 that has a swivel connection with valve housing 18. When the extinguisher is supported on bracket 85 plate 86 fits underneath nut 88.

The audible alarm unit is in this case a whistle mechanism comprised of a miniature bottle 90 containing pressurized gas; normally the gas is retained in the bottle by a valve connected to actuating plunger 92. When plunger 92 is moved toward (into) the bottle the valve is opened to allow the pre-pressurized gas to escape. Escape of the gas through the space around plunger 92 produces an audible whistling sound.

The position of plunger 92 is controlled by a cam plate 94 having a pivotal connection 96 with bracket 85. Conventional spring 97 biases plate 94 in a counterclockwise direction. To prevent premature motion of plate 94 a removable pin 99 may be inserted through an opening in plate 94; pin 99 abuts the upper face of plate 86. A second pin 93 is affixed to plate 94 to limit counterclockwise motion of the plate (when pin 99 is removed). When the fire extinguisher is installed onto bracket 85 it contacts plate 94. Thereafter pin 99 may be removed from plate 94. The weight (mass) of bottle 16 is appreciably larger than the force of spring 97 so that while the extinguisher is suspended from bracket 85 plate 94 maintains its position.

When the extinguisher is slid to the left out of bracket 85 spring 97 moves plate in a counterclockwise direction (until pin 93 strikes the upper surface of plate 86). The edge of plate 94 exerts a cam force on plunger 92, causing the plunger to move upwardly into bottle 90 for allowing the gas to be released through a very small opening. A whistling noise (similar to that of a conventional whistling tea kettle) is generated by the escaping gas.

It will be seen that plate 94 performs a sensing function similar to the function performed by plunger 72 in the FIG. 1 arrangement. Cam plate 94 can be used not only to control the whistle apparatus, but also to actuate a snap switch, not shown. Such a snap switch could be electrically connected into a central station alarm system of the type previously described. In an actual installation the operating apparatus would preferably be enclosed in some sort of housing. Numeral 91 indicates by dashed lines one possible housing outline (configuration).

If the invention were used on a number of fire extinguisher support mechanisms each support mechanism, or the associated fire extinguisher, would preferably be marked with a warning statement to the effect that removal of the extinguisher will automatically set off an audible alarm. This would allay fears of people using the extinguisher that they were causing a malfunction. The warning statement might also deter would-be thieves from removing the extinguishers for unauthorized purposes.

I wish it to be understood that I do not desire to be limited to the exact details of construction shown and described for obvious modifications will occur to a person skilled in the art, without departing from the spirit and scope of the appended claims.

I claim:

1. The combination comprising support mechanism for a portable fire extinguisher that is constructed to include a cylindrical bottle (16) having an end wall; and an alarm mechanism indicating that the extinguisher has been removed from the support mechanism:

said support mechanism comprising a hollow base (32) that includes coaxially a circular bottom wall (34), a cylindrical annular side wall (38), and a circular platform (36) spaced above the bottom wall within the space circumscribed by the side wall, said platform occupying a horizontal plane slightly below the upper edge of the annular side wall; the annular side wall having a diameter only slightly greater than the diameter of the fire extinguisher bottle whereby the bottle can be located in an upright attitude with its end wall resting on the aforementioned platform;

said alarm mechanism being located within the hollow base; said alarm mechanism comprising a cup-shaped gong (66) located above the aforementioned bottom wall in a centered position relative to the annular side wall, and a spring motor (60) within the space circumscribed by the gong, said spring motor having a socket means accessible to a turning key (70) through an opening in the base bottom wall; the key being operable to wind up the spring in the motor to a stressed condition;

said alarm mechanism further including a restraining latch operable to prevent spring motor unwind action; said restraining latch comprising a leaf spring (68) occupying a prone position beneath the aforementioned platform;

said alarm mechanism further including a sensor member (72) projecting upwardly from the leaf spring through an opening in the horizontal platform on the platform axis to contact the end wall of the fire extinguisher bottle whereby the leaf spring is then depressed to a position preventing unwind action of the motor spring; said leaf spring being operable to move to a position permitting unwind action of the motor spring when the extinguisher is removed from the platform;

the aforementioned annular side wall having a multiplicity of openings (78) therearound operable to transmit sound waves gnerated by the aforementioned gong; the diameter of the gong being only slightly less than the diameter of the annular side wall, whereby the alarm mechanism occupies a substantial percentage of the space circumscribed by the side wall.

* * * * *